US006728996B2

(12) United States Patent
Roscow

(10) Patent No.: US 6,728,996 B2
(45) Date of Patent: May 4, 2004

(54) ADJUSTABLE LINER RETAINER FOR CONTAINERS

(76) Inventor: Robert F. Roscow, 127 Woodlawn St., Hamden, CT (US) 06517

( * ) Notice: Subject to any disclaimer, the term of this patent is extended or adjusted under 35 U.S.C. 154(b) by 0 days.

(21) Appl. No.: 10/047,602

(22) Filed: Oct. 23, 2001

(65) Prior Publication Data

US 2003/0074770 A1 Apr. 24, 2003

(51) Int. Cl.[7] ..... A44B 18/00; B65B 67/12; B65D 77/00; B65F 1/06

(52) U.S. Cl. ..... 24/306; 24/287; 24/300; 24/442; 24/455; 24/482; 220/908; 220/908.1; 248/101

(58) Field of Search ..... 24/442, 287, 300, 24/482, 306, 455, 30.5 R, 30.5 P, 585.12; 403/325; 220/908, 908.1

(56) References Cited

U.S. PATENT DOCUMENTS

| | | | | | |
|---|---|---|---|---|---|
| 1,260,434 | A | | 3/1918 | Nordseth | |
| 2,761,480 | A | * | 9/1956 | Tames | 220/908 |
| 3,000,384 | A | * | 9/1961 | Piers, Jr. | 132/273 |
| 3,279,008 | A | | 10/1966 | Wallach | |
| 3,542,041 | A | * | 11/1970 | Mercorella | 24/306 |
| 3,614,041 | A | | 10/1971 | Koger | 248/97 |
| 3,632,029 | A | | 1/1972 | Sonner | 224/29 D |
| 3,679,125 | A | | 7/1972 | Forance et al. | 229/55 |
| 3,747,171 | A | * | 7/1973 | Montague, Jr. | 24/265 WS |
| 3,924,781 | A | | 12/1975 | Witte | 222/80 |
| 3,927,445 | A | | 12/1975 | Pavlish | 24/243 K |
| 3,940,873 | A | * | 3/1976 | Lawless | 24/306 |
| 4,287,701 | A | | 9/1981 | Washington | 53/390 |
| 4,312,489 | A | | 1/1982 | Paetzold | 248/97 |
| 4,338,979 | A | | 7/1982 | Dow | |
| 4,378,924 | A | | 4/1983 | Christensen | |
| 4,738,478 | A | | 4/1988 | Bean, Jr. | 294/55 |
| 4,805,858 | A | | 2/1989 | Taylor | 248/99 |
| 4,822,178 | A | | 4/1989 | Taylor | 383/33 |
| 4,864,698 | A | | 9/1989 | Brame | |
| 4,951,903 | A | | 8/1990 | Frey | 248/99 |
| 4,993,128 | A | | 2/1991 | Gold | |
| 5,086,543 | A | * | 2/1992 | Mitchell | 24/16 PB |
| 5,214,874 | A | * | 6/1993 | Faulkner | 24/442 |
| 5,518,136 | A | | 5/1996 | Muldner et al. | 220/404 |
| 5,556,063 | A | | 9/1996 | Boyd | 248/99 |
| 5,588,622 | A | | 12/1996 | Gordon, Sr. | 248/101 |
| 5,638,581 | A | | 6/1997 | Burke | |
| 5,740,939 | A | | 4/1998 | Muldner et al. | 220/404 |
| 6,056,147 | A | | 5/2000 | Jarman | |
| 6,205,623 | B1 | | 3/2001 | Shepard et al. | |
| 6,381,812 | B1 | | 5/2002 | Crider et al. | |

* cited by examiner

*Primary Examiner*—Victor Sakran
(74) *Attorney, Agent, or Firm*—McCormick, Paulding & Huber LLP

(57) ABSTRACT

An adjustable liner retainer system comprising a container having an opening defining an upper edge and an outer surface and a liner situated in the container wherein an upper portion of the liner extends from the opening, folds over the upper edge, and at least partly hangs below the upper edge adjacent to the outer surface of the container. An adjustable liner retainer is tensioned around an upper end of the container pressing the hanging upper portion against the outer surface of the container. The adjustable liner retainer comprises a strip of material at least a portion of which is elastomeric material to create the tension to press the liner to the outer surface. A hook portion and a loop portion of the hook-and-loop fastener are attached to the first and second ends of the strip.

15 Claims, 3 Drawing Sheets

ADJUSTABLE LINER RETAINER FOR CONTAINERS

FIELD OF THE INVENTION

The present invention relates to a liner bag retainer that prevents liner bags from progressively slipping into containers as they are filled with material and allows for much greater compaction of material within the container. The retainer strip also provides a means for making containers utilizing liner bags more attractive and providing a medium for many types of information and identification.

BACKGROUND OF THE INVENTION

Liner bags, principally fabricated from thin plastic film or paper, are used today in a wide variety of containers as well as compactors for the purposes of hygiene as well as convenience. They are extremely popular for these reasons and have become ubiquitous. Liners obviate the need to clean trash or garbage containers as well as making it extremely convenient and safe to dispose of their contents. One doesn't have to touch the container's contents in any manner or have to carry a local container to the main collection area, just the liner with its contents sealed. Sealing is accomplished easily by the use of the wire ties, integral drawstrings, or hand tying the liner tops into a knot. Liners have become a common part of our lives and additionally have also been commonly used to store various materials other than refuse in containers.

Liner bags are manufactured in many sizes to accommodate the wide variety of sizes and styles of containers on the market. The liner bags, however, are manufactured in a limited number of sizes and generally do not fit tightly to most containers when the top of the bag is folded over the top of the container to secure it in place. This inability to positively retain the liner in place leads to slippage of the bag into the container that is bothersome and a consequent inefficient use of liner bags. Liners are usually never packed to the container capacity that they are capable of handling.

U.S. Pat. Nos. 5,740,939 and 5,518,136 refer to liner retainers for containers. Each discloses an elastic retainer member formed in a continuous loop and an attached connector member and anchor member. The retainer member holds a liner to a container while the connector and anchor members secure the retainer member to the container.

U.S. Pat. No. 4,822,178 discloses a bag comprising of hook and loop fastener strips along the top opening of the bag to provide a means for securely closing the bag. When supported on a hamper stand, the top portion of the bag with the hook and loop fastener strips is folded over the top of the stand. The hook and loop fastener strips on the top of the bag can be fastened to the hook and loop fastener tabs stitched to the outside of the bag to secure the bag on the hamper stand.

U.S. Pat. No. 3,927,445 discloses an elastic retaining loop for holding the outwardly turned upper edge portion of a bag type liner against the outer surface of a rigid refuse container with means of adjusting the circumferential size of the retainer to accommodate containers of different sizes. Likewise, U.S. Pat. No. 5,556,063 also discloses an elastic trash bag retaining band.

What is desired, therefore, is a simple elastic strip that can easily be circumferentially placed around the selvage end or folded over top of a liner bag positioned in a container, stretched tightly around a container of various cross-sections suitable for the size of liner bag utilized, and then positively fastened by means of hook-and-loop fasteners attached at the strip's ends. What is further desired is a means of covering the attachment area of the strip or providing for information or identification to be placed on the strip.

SUMMARY OF THE INVENTION

Accordingly, it is an object of the invention to provide an adjustable liner retainer to prevent slippage of liner bags into containers thereby allowing for far greater compaction and economy in the use and changing of bag liners.

A further object of this invention is to provide a simple means of hiding the retainer connectors for not only aesthetic reasons but also to provide a convenient method of attaching information.

Another object of this invention is to provide a retainer liner that can be designed to accommodate the vast range of liner bags and be attachable and detachable in one-step.

These and other objects of the invention are achieved by provision of an adjustable liner retainer system comprising a container having an opening defining an upper edge and an outer surface and a liner situated in the container wherein an upper portion of the liner extends from the opening, folds over the upper edge, and at least partly hangs below the upper edge adjacent to the outer surface of the container. An adjustable liner retainer is tensioned around an upper end of the container pressing the hanging upper portion against the outer surface of the container. The adjustable liner retainer comprises a strip of material at least a portion of which is elastomeric material to create the tension to press the liner to the outer surface. A hook portion and a loop portion of the hook-and-loop fastener are attached to the first and second ends of the strip. The hook-and-loop fastener detachably connects said first and second ends of said strip Preferably, the liner retainer further includes an ornament attached to the strip on the opposite side of at least one of said hook portion and loop portion. Alternatively, the liner retainer may include a cover plate containing various information in lieu of or in addition to the ornament. The elastomeric material of the liner retainer is preferably comprised of a textile material, such as spandex. The liner retainer may further include a tab located at each of the first and second ends of the strip to facilitate operation of the hook-and-loop fastener.

The invention and its particular features and advantages will become more apparent from the following detailed description considered with reference to the accompanying drawings.

DETAILED DESCRIPTION OF THE DRAWINGS

Figure 1:
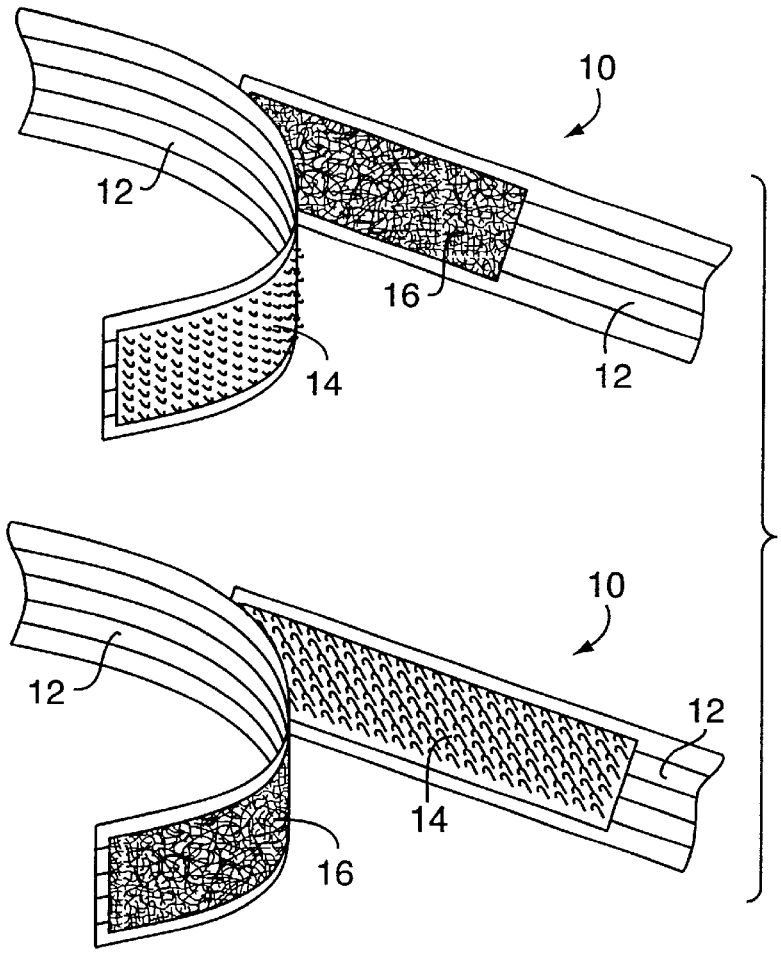
FIG. 1 is a perspective view of the adjustable liner retainer in accordance with the invention showing the hook-and-loop fasteners and their associated reversibility.
Figure 2:
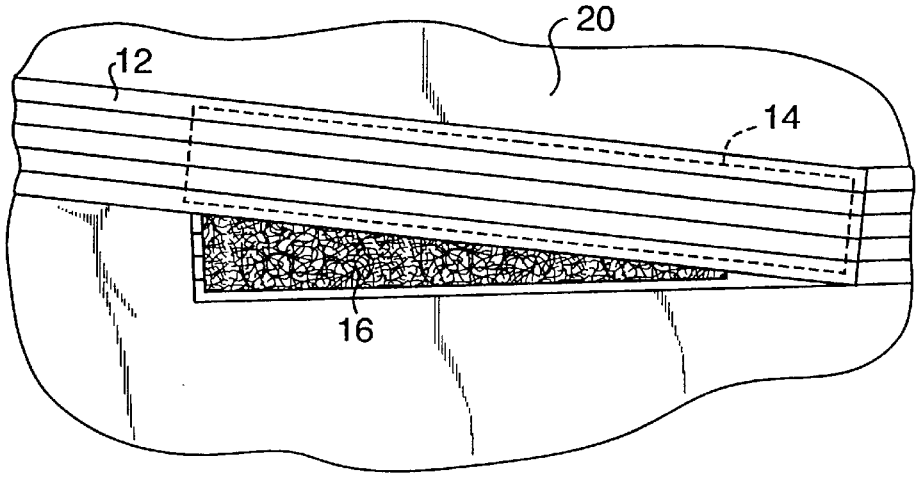
FIG. 2 is a perspective view of the hook-and-loop attachment points of the liner retainer of FIG. 1 showing misalignment.

FIGS. 1–8 depict an adjustable liner retainer 10 in accordance with the present invention. The adjustable liner retainer 10 comprises a strip 12 of elastomeric material having a first end and a second end and a first side and a second side with hook-and-loop fastener strips 14,16 attached at either end on opposite sides of the strip 12. For example, the hook strip 14 of a hook-and-loop fastener may be attached to the first end of the strip 12 on the first side and the loop strip 16 of the hook-and-loop fastener may be attached to the second end of the strip 12 on the second side. In this manner, as shown in FIGS. 1 and 2, when the strip 12 is extended around a container 18, the hook and loop strips of the fastener 14,16 are presented adjacent to one another such as to avoid any unnecessary twisting of the strip 12 and permit the strip 12 to lie flat against the container 18. This arrangement further provides reversibility of the liner retainer attachment ends, as also shown in FIGS. 1 and 2. As such, the liner retainer 10 may therefore be switched end to end or the faces reversed, i.e., turned over. As long as the liner retainer 10 lies substantially flat against the container 18, it can be correctly attached.

The hook-and-loop material may any such material such as that which is available under the trademark VELCRO® from Velcro Industries B.V. of the Netherlands. The elastomeric material 12 may be any material having elastic properties. Preferably, the elastomeric material is a standard elastic textile material, such as a polyester/cotton woven or knitted material incorporating rubberized or other elastic yarn, such as spandex. Standard elastic textile materials allow the retainer to be washed and are generally available in different colors, patterns, or combinations thereof. Other materials could, however, be used for special applications, for example flat rubber strips. The strip 12, as well as the hook-and loop fastener strips 14, 16 may be manufactured in different widths and lengths depending on the size of the container 18 on which the retainer 10 is to be used and the level of adjustability desired. It is to be understood that non-elastic strips of material could be used in combination with the strips of elastomeric material to form the retainer 12 as long as sufficient stretch for tensioning the retainer 10 and easy adjustment is permitted.

The length of the strip 12 as well as the hook-and-loop fastener strips 14, 16 are selected to fit containers of varied cross-section that utilize the similar liners 20, for example thirteen gallon trash bags, permitting the retainer 10 to fit all sizes of containers using a specific liner bag size or capacity category. Such also permits simple and effortless adjustment of the retainer 10 without undo stretching or adjustment. Attachment of the retainer 10 to a container 18 is accomplished by inserting a liner 20 into the container 18 such that an upper portion 22 of the liner 20 extends from the opening of the container 18 and folds over the upper edge of the container 18 and hangs adjacent the outer surface of the container 18. The retainer 10 is then wrapped around the folded upper portion 22 of the liner 20 on the container 18 and the corresponding hook-and-loop strips 14, 16 are attached to one another. The elastomeric strip 12 allows for adjustment by stretching and the hook-and-loop fastener strips 14, 16 also allow adjustment since only a small area of one fastener strip, i.e., the hook side, needs to attach to the other strip, i.e., the loop side. Attachment also does not require that the retainer 10 be positioned from any certain direction or side as the mechanism of the hook-and-loop fasteners obviates this requirement. The retainer 10 may even be somewhat twisted and still serve its purpose as long as the fastener strips 14, 16 are correctly aligned. However, it is to be understood that the fastener strips 14, 16 of the liner retainer 10 do not have to be perfectly aligned to provide a secure connection over the liner bag 20, as shown in FIG. 2. Although the loop strip 16 of the liner retainer 10 is partially exposed and misaligned with the hook end 14, such an attachment is sufficient to secure the liner 20 within the container 18.

Unlocking the retainer is easily achieved by pulling apart the hook and loop fastener of the retainer 12. Unlocking could be further facilitated by adding a fabric or other material tab or loop to each end of the retainer 12. Under either design, the hook-and loop fasteners 14, 16 tear apart easily. The retainer 10 can then be laid to one side while the liner 20 is sealed and removed and another liner 20 installed. Retainers 10 could also be attached for temporary storage to the containers 18 with hook-and-loop fastener strips adhered to them or on strips adhered to belts for use by personnel or attached to housekeeping carts.

The liner retainer 10 creates sufficient friction by compressing the liner 20 against the outer surface of the container 18 to overcome the friction produced when inserting items into the container and/or compacting waste in the container. The retainer 10 may also create continuous contact of the liner 20 with a lip 24 commonly formed at the top of the container 18 around the opening thereof. Although the cross-section of the lip 24 may be fairly narrow for some containers, it is important to maintain this circumferential strip of contact to dissipate any unequal forces exerted by materials being compacted against the inside of the container 18 and liner 20. Also, rectangular containers often are concave in their long dimension below the lip 24 and only a small part of the sides of the folded upper portion of the liner 20 may be in direct contact with the container 18. This condition makes it all the more important that the lip 24 be continuously tensioned in contact with the folded upper portion 22 of the liner 20. The retainer 20 through both types of friction producing contact allows for liner 20 to be compacted many more times than when not in use by preventing the liner 20 from slipping. It should be noted also that the liner 20 itself has very little strength and it is the rigidity of the container 18 that provides the resistance necessary to deform the refuse being compressed. The liner 20 eventually conforms to the shape of the container 20 as a result of the pressing of the refuse. A typical thin plastic liner bag 20 used alone without a container 18 often can hold very little because they tend to rip or tear apart under pressure and from sharp edges.

Figure 3:
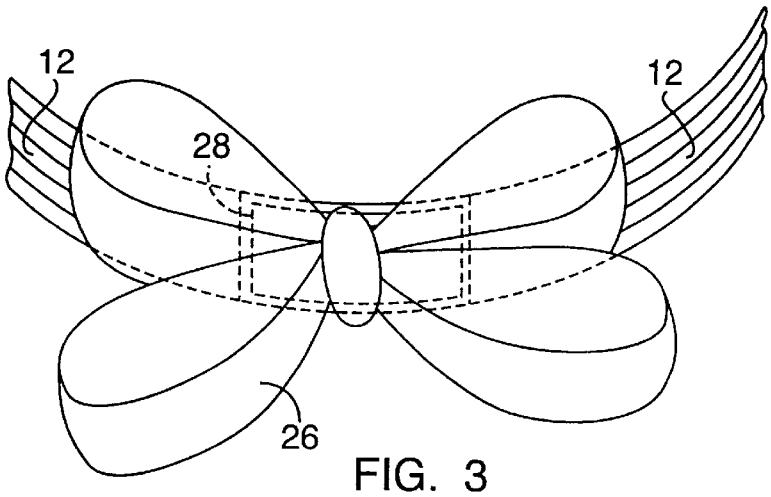
FIG. 3 is a perspective view of the attachment of an ornament to the attachment points of the liner retainer of FIG. 1.
Figure 4:
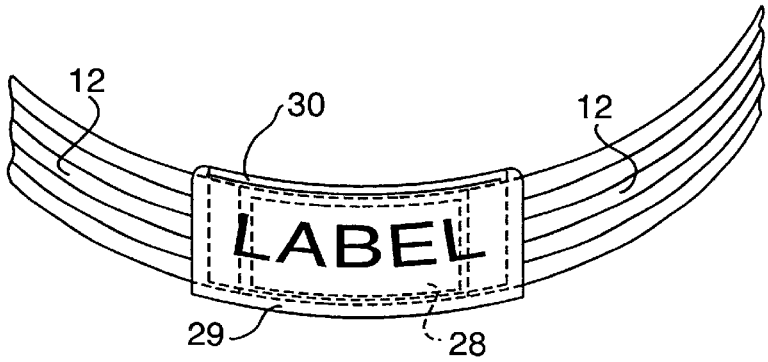
FIG. 4 is a perspective view of the attachment of an informational cover plate to the attachment points of the liner retainer of FIG. 1.

Tabs or short strips of hook-and-loop fastener can be adhered or sewn to the retainer 10 opposite the attachment strips 14, 16 to secure ornamental or informational objects or signage to provide information or cover the outside of the fastener strips 14, 16, as shown in FIGS. 3 and 4. Typically, the tops of liners 20 are tied in a knot to make them better fit the container 18 to which they are being inserted. This procedure is not only ineffective in limiting the slippage of the liner 20 into the container 18 but is also unsightly, especially in public areas, offices, and hotel and motel rooms. For example, a company logo, bow, code plate, bar code, nameplate, etc. could be readily attached quickly to the liner retainer 10 after it is secured to the container 18 for aesthetic or informational purposes. Although liners 20 are primarily used for waste receptacles, their usage to segregate contents of containers from each other has become widespread, especially where the consumer does not want to clean the residue of the container's prior contents before reusing the container 18.

FIG. 3 illustrates how an ornamental covering or informational plate can be attached over the attachment ends 14, 16 of the liner retainer 10. The ornamental covering 26, such as a decorative bow as shown in FIG. 3, having an integral hook-and-loop fastener may be affixed to the sides of the retainer 10 opposite the attachment strips 14, 16. Small patches 28 of either or both types of hook-and-loop fastener could be attached to the ornament 26 and on the non-fastener sides of the ends of the retainer 10 to achieve easy attachment of the ornament 26 to the retainer 10. The ornament 26 would be simply snapped on and off during the process of changing the liner or stay attached to one end. FIG. 4 illustrates how a folded plastic, fabric, paper, or other flexible and printable material could be made into a cover plate 28 and attached over the ends of the liner retainer 10. The front face of this flexible cover plate 28 could contain advertising, identification information, bar codes, labels, or any other type of information desired. A bend 30 in its fold could be designed to keep the plate 28 permanently folded or patches of hook-and-loop fasteners could be attached to the inside face of the front side and inside face of the back side. The cover plate 28 could be completely removed each time the liner 26 was changed or designed to slip to the side while changing. It is to be understood that the ornament 26 or cover plate 28 may also be attached to the retainer 10 permanently, such as by gluing or stitching, or attached to the retainer 10 at other locations on the retainer 10.

Figure 5:
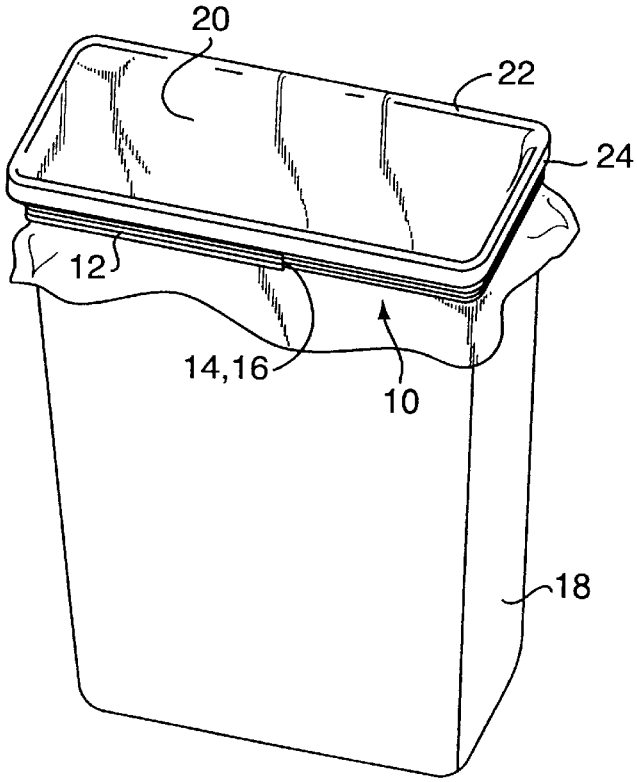
FIG. 5 is a perspective view of the liner retainer of FIG. 1 employed on an open type rectangular container.
Figure 6:
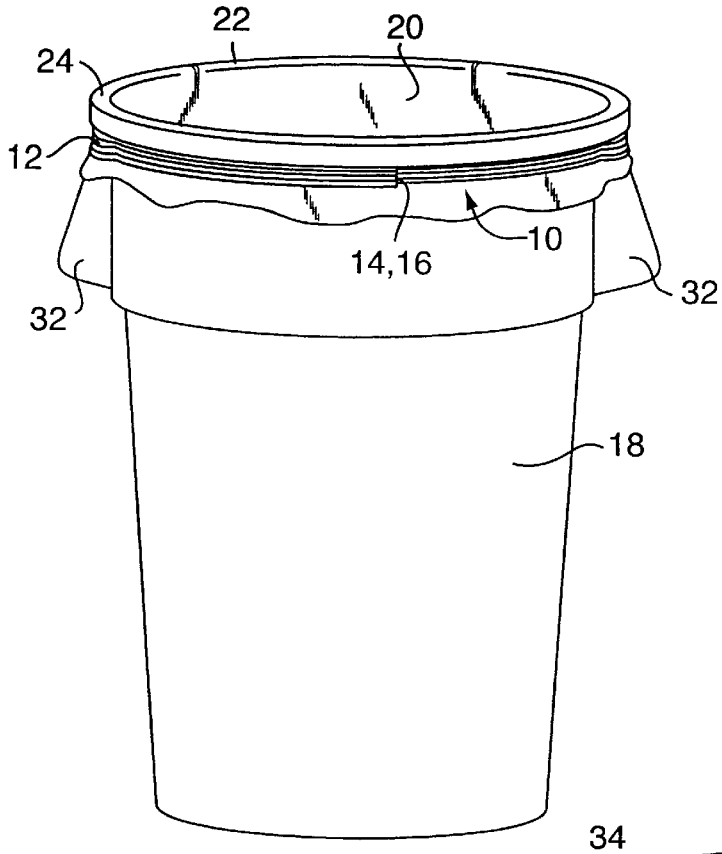
FIG. 6 is a perspective view of the liner retainer of FIG. 1 employed on a round container with handles near the lip.
Figure 8:
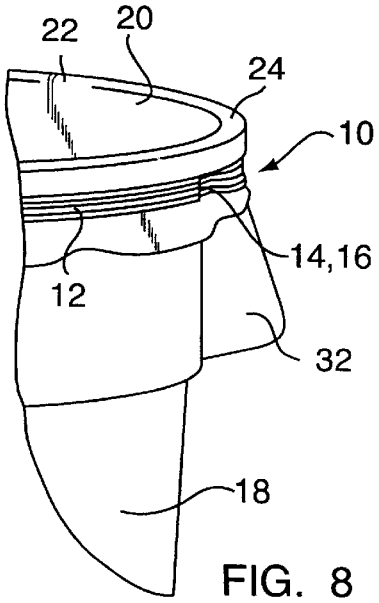
FIG. 8 is a perspective view of the liner retainer near the handle of FIG. 6.
Figure 7:
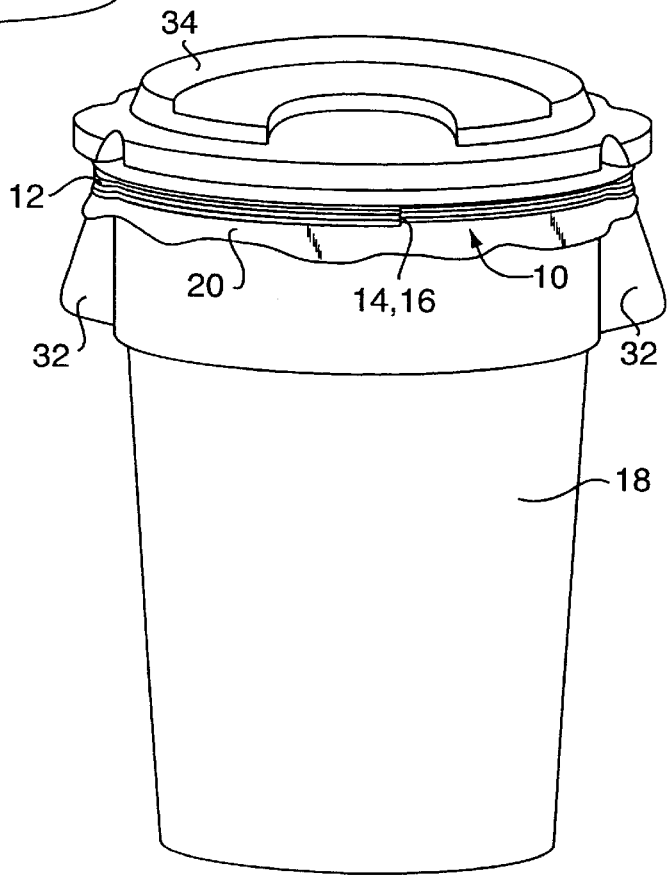
FIG. 7 is a perspective view of the liner retainer of FIG. 1 employed on a round container with handles near the lip and a lid.

The retainer 10 is not limited to any particular size or shape container 18. FIG. 5 shows the adjustable liner retainer 12 utilized on a rectangular container 18 in which has been inserted a liner bag 20. The liner 20 has been pushed fully into the container 18. The liner retainer 10 has been circumferentially wrapped around the folded-over upper portion 22 of the liner 20 and attached at its attachment strips 14, 16. The liner 20 is tensioned into continuous contact with the container's lip 24 as well as the sides of the container 18. The adjustable liner retainer 10 utilized on a round refuse container 18 with handles 32 integral with its lip 24 is shown in FIG. 6. The liner retainer 10 has been positioned beneath the lip 24 of the container 18 and draped over the handles 32. In this position, the liner retainer 10 is still able to tension sufficiently the folded upper portion 22 of the liner 20 against the sides of the container 18 and lip 24. The liner retainer 10 can also be positioned below the handles 32 of a round container 18 as shown in FIG. 7. The container lid 34 in this situation is completely separated from the liner retainer 10 and handles 32. The attachment ends 14, 16 are still easily accessible. FIG. 8 shows a close-up view of how the liner retainer 10 fits snugly over the handle 32 of the round container 18, also illustrated in FIG. 6. The folded portion 22 of the liner 20 above the handle 32 is captured by the liner retainer 10 and also tensioned continuously along the lip 24. The attachment strips 14, 16 can even be located at this point without interference.

Although the invention has been described with reference to a particular arrangement of parts, features, and the like, these are not intended to exhaust all possible arrangements or features, and indeed many other modifications and variations will be ascertainable to those of skill in the art.

What is claimed is:

1. An adjustable liner retainer system comprising:

a container having an opening defining an upper edge and an outer surface;

a liner situated in said container wherein an upper portion of said liner extends from said opening, folds over said upper edge, and at least partly hangs below said upper edge and adjacent to said outer surface of said container;

an adjustable liner retainer tensioned around an upper end of said container pressing said hanging upper portion against said outer surface of said container; said adjustable liner retainer comprising a strip of material having a first end, a second end, a first side and a second side wherein at least a portion of said strip of material is comprised of elastomeric material to create tension to press said liner to said outer surface;

a hook portion of a hook-and-loop fastener attached to said first end of said strip on said first side; and a loop portion of the hook-and-loop fastener attached to said second end of said strip on said second side, and said hook-and-loop fastener detachably connecting said first and second ends of said strip.

2. The liner retainer of claim 1 further including an ornament attached to said strip of material on either said first side or said second side, opposite of at least one of said hook portion and loop portion.

3. The liner retainer of claim 1 further including a cover plate attached to said strip of material on either said first side or said second side, opposite of at least one of said hook portion and loop portion.

4. The liner retainer of claim 1 wherein said elastomeric material is comprised of a textile material.

5. The liner retainer of claim 1 further comprising a tab located at each of said first and second ends of said strip to facilitate operation of said hook-and-loop fastener.

6. An adjustable liner retainer comprising:

a strip of material having a first end, a second end, a first side and a second side in the form of a band wherein at least a portion of said strip of material is elastomeric material;

said band having a length sufficient to extend around a substantial portion of a container;

a hook portion of a hook and loop fastener attached to said first end of said strip on said first side;

a loop portion of the hook and loop fastener attached to said second end of said strip on said second side.

7. The liner retainer of claim 6 further including an ornament attached to said strip on either said first side or said second side, opposite of at least one of said hook portion and loop portion.

8. The liner retainer of claim 6 further including a cover plate attached to said strip on either said first side or said second side, opposite of at least one of said hook portion and loop portion.

9. The liner retainer of claim 6 wherein said elastomeric material is comprised of a textile material.

10. The liner retainer of claim 6 further comprising a tab located at each of said first and second ends of said strip to facilitate operation of said hook-and-loop fastener.

11. An adjustable liner retainer comprising:

a strip of elastomeric material in the form of a band having a first end and a second end and a first side and a second side;

said band having a length sufficient to extend around a substantial portion of a container:

a hook portion of a hook-and-loop fastener attached to said first end of said strip on said first side; and, a loop portion of said hook-and-loop fastener attached to said second end of said strip on said second side.

12. The liner retainer of claim 11 further including an ornament attached to said strip of material on either said first side or said second side, opposite of at least one of said hook portion and loop portion.

13. The liner retainer of claim 11 further including a cover plate attached to said strip of material on either said first side or said second side opposite of at least one of said hook portion and loop portion.

14. The liner retainer of claim 11 wherein said elastomeric material is comprised of a textile material.

15. The liner retainer of claim 11 further comprising a tab located at each of said first and second ends of said strip to facilitate operation of said hook-and-loop fastener.

* * * * *